US010674818B2

(12) United States Patent
Mars

(10) Patent No.: US 10,674,818 B2
(45) Date of Patent: Jun. 9, 2020

(54) AUTOMOBILE DOOR HANGER APPARATUS

(71) Applicant: David Mars, Las Vegas, NV (US)

(72) Inventor: David Mars, Las Vegas, NV (US)

( * ) Notice: Subject to any disclaimer, the term of this patent is extended or adjusted under 35 U.S.C. 154(b) by 0 days.

(21) Appl. No.: 16/136,431

(22) Filed: Sep. 20, 2018

(65) Prior Publication Data

US 2019/0082832 A1 Mar. 21, 2019

Related U.S. Application Data

(60) Provisional application No. 62/560,997, filed on Sep. 20, 2017.

(51) Int. Cl.

| | |
|---|---|
| ***A47B 81/00*** | (2006.01) |
| ***A47B 96/14*** | (2006.01) |
| ***A47F 7/00*** | (2006.01) |
| ***B25H 5/00*** | (2006.01) |
| ***A47F 5/08*** | (2006.01) |

(52) U.S. Cl.

CPC ..... *A47B 81/00* (2013.01); *A47B 96/1441* (2013.01); *A47F 5/08* (2013.01); *A47F 7/0021* (2013.01); *B25H 5/00* (2013.01)

(58) Field of Classification Search

CPC ..... A47B 81/00; A47B 96/1441; A47B 96/00; A47B 2220/0036; A47G 25/06; A47G 25/1614; A47G 25/0628; A47G 25/0635; A47G 25/0642; A47F 5/08; A47F 7/00; A47F 5/00; A47F 5/0006; A47F 7/0021; B62H 3/00; B62H 3/12; B60R 9/06; B60R 7/046; B60R 7/08; B60R 7/005; B60R 11/00; B60R 9/00; F16M 13/02; B25H 5/00

USPC .... 211/85.1, 85.11, 41.1, 13.1, 87.01, 41.14, 211/88.04, 18, 119.009, 119.004, 70.6, 211/85.7; 248/200, 309.1, 339, 301, 304; 224/532, 533, 543, 545, 557, 567

See application file for complete search history.

(56) References Cited

U.S. PATENT DOCUMENTS

| | | | | |
|---|---|---|---|---|
| 2,986,366 A * | 5/1961 | Wesson | F16M 13/02 | 248/285.1 |
| 3,017,036 A * | 1/1962 | Albert | A47G 1/17 | 211/87.01 |
| 5,018,323 A * | 5/1991 | Clausen | A47F 5/0846 | 211/189 |
| 5,303,828 A * | 4/1994 | Paullin | A47F 5/0876 | 211/85.7 |
| 5,330,312 A * | 7/1994 | Allsop | B60R 9/06 | 224/505 |
| 5,642,820 A * | 7/1997 | Angeles | B62H 3/06 | 211/103 |
| 5,806,687 A * | 9/1998 | Ballesteros | H04Q 1/09 | 211/169 |

(Continued)

*Primary Examiner* — Jennifer E. Novosad

(74) *Attorney, Agent, or Firm* — Boudwin Intellectual Property; Daniel Boudwin

(57) ABSTRACT

An automobile door hanger apparatus. The automobile door hanger apparatus includes a vertical member with two arms. The two arms have two plates on them that provide tubular members. The tubular members are in vertical alignment and are sized so that a removable automobile door can be attached to them. The automobile door hanger apparatus allows for four removable automobile doors to be attached to it such that the doors are safely and effectively stored.

6 Claims, 3 Drawing Sheets

(56) References Cited

U.S. PATENT DOCUMENTS

| | | | | |
|---|---|---|---|---|
| 6,286,692 | B1 * | 9/2001 | Hemping | A47F 7/00 206/325 |
| 6,679,537 | B1 * | 1/2004 | Putnam, Jr. | B62J 17/04 211/18 |
| 6,811,038 | B1 * | 11/2004 | Sanderson | A47B 81/00 211/13.1 |
| 7,275,670 | B1 * | 10/2007 | Shumack | B60R 9/06 224/518 |
| 7,971,841 | B2 * | 7/2011 | Van Wyk | A47B 81/00 211/123 |
| 8,210,365 | B2 * | 7/2012 | Van Wyk | A47B 81/00 211/85.3 |
| 8,616,383 | B1 * | 12/2013 | Miller | B68C 1/002 211/1.51 |
| 9,398,719 | B2 * | 7/2016 | Westby | F16M 11/18 |
| 9,623,807 | B2 | 4/2017 | Singleton | |
| 2007/0163975 | A1 * | 7/2007 | Holland | A63B 71/0036 211/85.7 |
| 2007/0181624 | A1 | 8/2007 | Smith | |
| 2019/0082832 | A1 * | 3/2019 | Mars | A47B 96/1441 |

* cited by examiner

AUTOMOBILE DOOR HANGER APPARATUS

CROSS REFERENCE TO RELATED APPLICATIONS

This application claims the benefit of U.S. Provisional Application No. 62/560,997 filed on Sep. 20, 2017. The above identified patent application is herein incorporated by reference in its entirety to provide continuity of disclosure.

BACKGROUND OF THE INVENTION

The present invention relates to an automobile door hanger apparatus. More specifically, the automobile door hanger apparatus provides up to four interfaces configured to receive a door of an automobile thereon.

Some automobiles have doors that are removable to provide convenience to the user. For example, the Jeep Wrangler contains doors that are removable by a user, such as to enjoy pleasant weather.

When a user decides to remove the doors of the automobile, he or she will typically place the doors in a storage location, such as a garage or a shed. Some users may lay the doors on the floor or may hang them in a place that obstructs the path of the storage area. This may cause damage to the doors however if they are stepped on or knocked over, leading to costly repair or replacement costs.

Therefore, there is a need for an apparatus that will safely and effectively provide a means to secure automobile doors that have been removed from an automobile. Furthermore, the apparatus should provide convenience to a user by being easy to set up and to use.

SUMMARY OF THE INVENTION

In view of the foregoing disadvantages inherent in the known types of automobile door hangers now present in the known art, the present invention provides an automobile door hanger wherein the same can be utilized for providing convenience for the user when securing a plurality of automobile doors for storage.

The present system comprises a vertical member having a top end and a bottom end. The vertical member tapers inwardly from the bottom end to the top end. A first support arm and a second support arm extend perpendicularly from the top end and the bottom end of the vertical member respectively. A pair of first plates and a pair of second plates are disposed on each of the first support arm and the second support arm. A pair of vertically oriented tubular members are disposed on a pair of opposing ends of each of the first plates and second plates, such that a first interface, a second interface, a third interface, and a fourth interface are defined by each pair of vertically-oriented corresponding tubular members. Each of the first interface, second interface, third interface and fourth interface is configured to receive a removable automobile door thereon.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
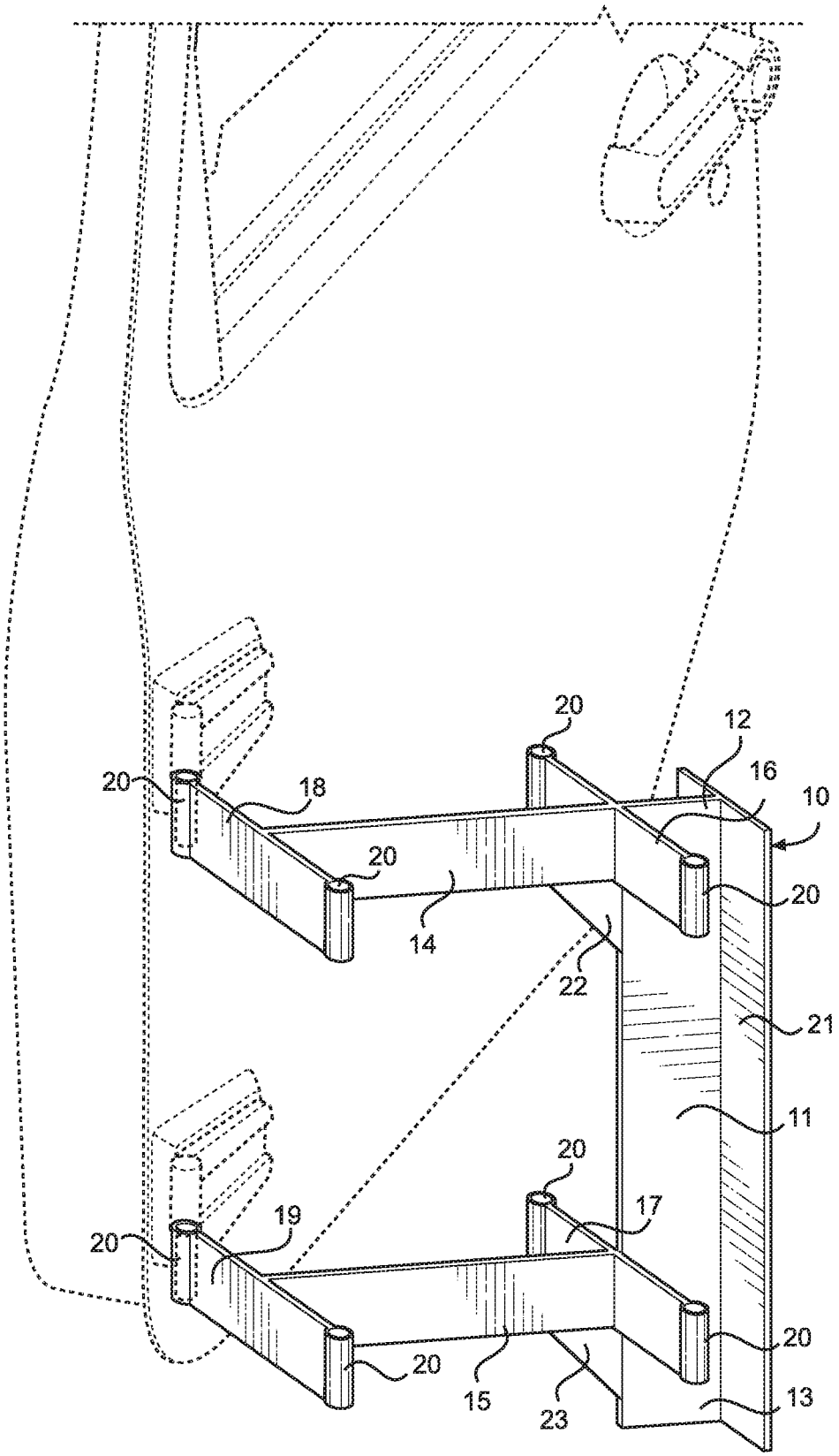
FIG. 1 shows a perspective view of an embodiment of the automobile door hanger apparatus.

Reference is made herein to the attached drawings. Like reference numerals are used throughout the drawings to depict like or similar elements of the automobile door hanger apparatus. The figures are intended for representative purposes only and should not be considered to be limiting in any respect.

Referring now to FIG. 1, there is shown a perspective view of an embodiment of the automobile door hanger apparatus. The automobile door hanger apparatus 10 comprises a vertical member 11. The vertical member 11 has a top end 12 disposed oppositely a bottom end 13. The vertical member 11 tapers inwardly from the bottom end 13 to the top end 12.

A first support arm 14 extends perpendicularly from the top end 12 of the vertical member 11. The first support arm 14 is rigid such that the first support arm will not sway or bend. Swaying or bending of the first support arm 14 could cause damage to the removable automobile doors. In the illustrated embodiment, the first support arm 14 is rectangular.

A second support arm 15 extends perpendicularly from the bottom end 13 of the vertical member 11. The second support arm 15 is also rigid such that the position of the removable automobile door placed thereon will be preserved. In the illustrated embodiment, the second support arm 15 forms a unitary piece with the vertical member 11 and the first support arm 14. In the shown embodiment, the first support arm 14 and the second support arm 15 extend outward from the vertical member 11 at an identical linear distance. The vertical length between the first support arm 14 and the second support arm 15 is dimensioned such that a removable automobile door can be placed between them.

A pair of first plates 16, 17 are disposed on a base end of each of the first support arm 14 and the second support arm 15. Each of the first support arm 14 and the second support arm 15 extend through each of the pair of first plates 16, 17. Each first plate 16, 17 is disposed on the first support arm 14 and the second support arm 15 such that the linear distance at which the first plates extend from the first support arm 14 and the second support arm 15 at an equivalent linear distance on each side thereof. Furthermore, the pair of first plates 16, 17 are in vertical alignment with each other.

A pair of second plates 18, 19 are disposed on a distal end of each of the first support arm 14 and the second support arm 15. Each second plate 18, 19 is disposed on the first support arm 14 and the second support arm 15 such that the linear distance at which the pair of second plates 18, 19 extend from the first support arm 14 and the second support arm 15 at an equivalent linear distance on each side thereof. Furthermore, the pair of second plates 18, 19 are in vertical alignment with each other.

A pair of vertically oriented tubular members 20 are disposed on a pair of opposing ends of each of the pair of first plates 16, 17 and the pair of second plates 18, 19. Each tubular member 20 of the first plate 16 of the first support arm 14 corresponds with the tubular member 20 of the first plate 17 of the second support arm 15 directly below in vertical alignment. Furthermore, each tubular member 20 of the second plate 18 of the first support arm 14 corresponds with the tubular member 20 of the second plate 19 of the second support arm 15 directly below in vertical alignment.

Thus, each vertically corresponding pair of vertically oriented tubular members 20 forms an interface. As illustrated, a first interface, a second interface, a third interface and a fourth interface are defined. Each of the first interface, the second interface, the third interface and the fourth interface are each configured to receive a removable automobile door therein. In one embodiment, the removable automobile door is placed into the interface by the action of a pin that is placed through the tubular member 20. Since the tubular members 20 are in vertical alignment with a corresponding tubular member 20, a plurality of removable automobile doors can be placed into each interface without placing tension across the removable automobile doors.

In the shown embodiment, the automobile door hanger apparatus 10 further comprises a mounting plate 21. The mounting plate 21 is disposed on an edge of the vertical member 11 opposite the first support arm 14 and the second support arm 15. The mounting plate 21 is of any suitable configuration for securing the automobile door hanger apparatus 10 to a vertical support surface. In one embodiment, the mounting plate 21 comprises a plurality of fasteners thereon, such that the mounting plate can be secured to the vertical support surface by the plurality of fasteners.

In the illustrated embodiment, the automobile door hanger apparatus 10 further comprises a pair of braces 22, 23 that are in connection with each of the first support arm 14 and the second support arm 15 and the vertical member 11. The braces 22, 23 are configured to provide cantilever support each of the first support arm 14 and the second support arm 15. The placement of the pair of braces 22, 23 is such that the force exerted on the first support arm 14 and the second support arm 15 is partially reduced because it is exerted on the vertical member 11 as well. By providing additional cantilever support, the automobile door hanger apparatus 10 is further stabilized and the amount of tension exerted upon the removable automobile doors is reduced.

Figure 2:
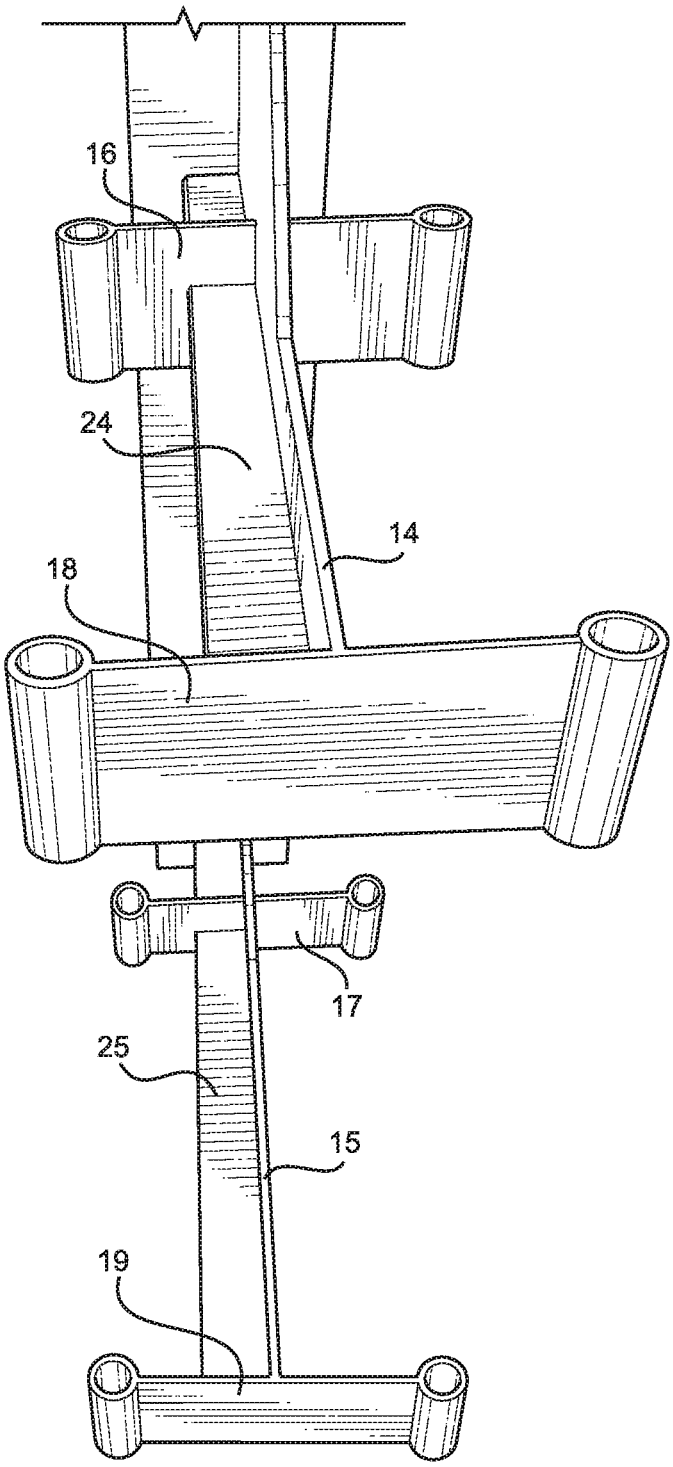
FIG. 2 shows a perspective view of an alternate embodiment of the automobile door hanger apparatus.

Referring now to FIG. 2, there is shown a perspective view of an alternate embodiment of the automobile door hanger apparatus. In the illustrated embodiment, each of the first support arm 14 and the second support arm 15 further comprises a support rod 24, 25. As shown, each support rod 24, 25 extends from each first plate of the pair of first plates 16, 17 to each corresponding second plate of the pair of second plates 18, 19. The support rods 24, 25 are further configured to provide stability to the first support arm 14 and the second support arm 15. In the illustrated embodiment, a support rod 24,25 is disposed on each side of the first support arm 14 and the second support arm 15.

Figure 3:
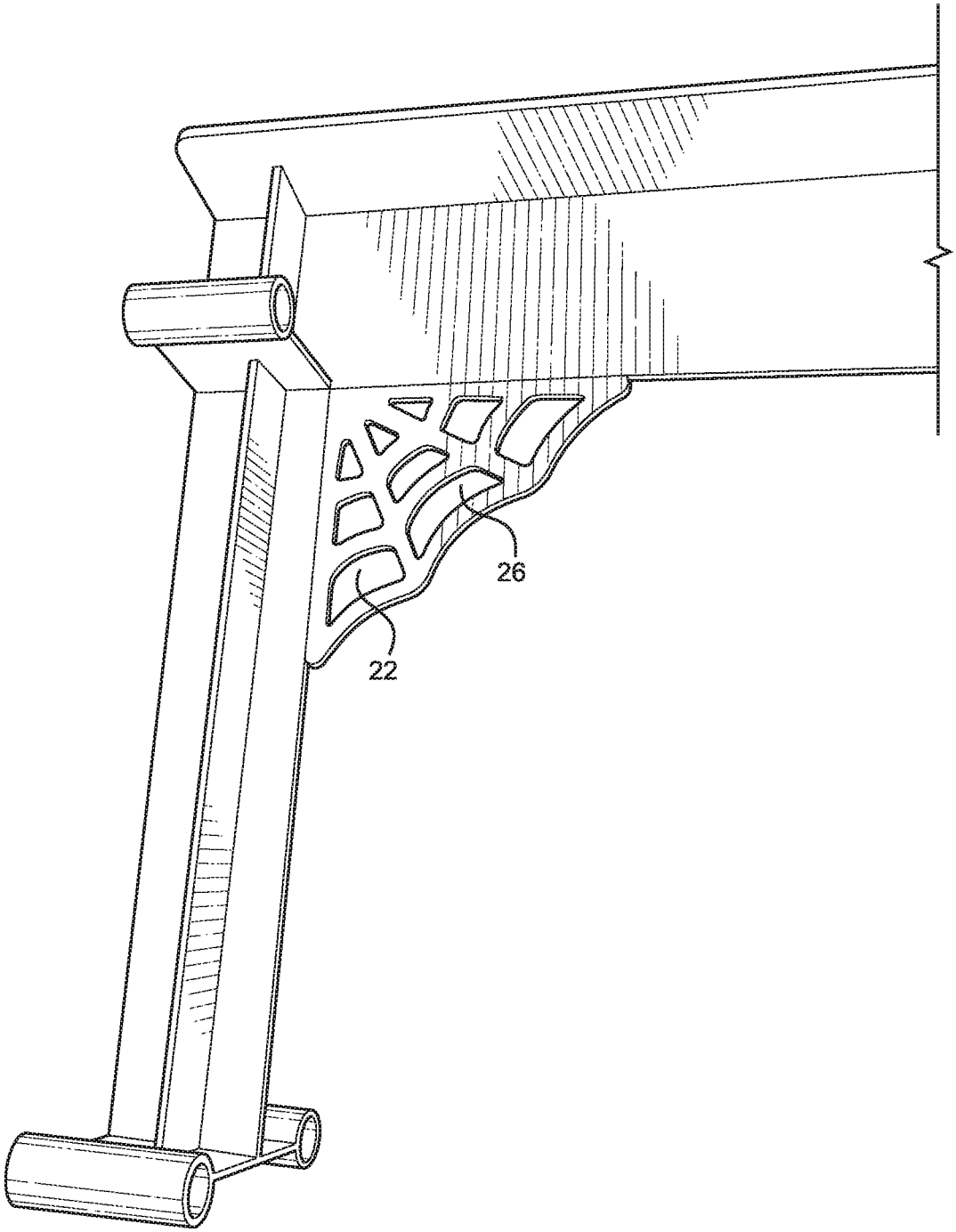
FIG. 3 shows a close-up view of a brace of an embodiment of the automobile door hanger apparatus.

Referring now to FIG. 3, there is shown a close-up view of a brace of an embodiment of the automobile door hanger apparatus. In the illustrated embodiment, each brace 22 comprises a plurality of apertures 26 therethrough. The plurality of apertures 26 are configured to provide additional stability to the brace 22 such as to reduce the amount of tension exerted upon the removable automobile doors when they are stored on the automobile door hanger apparatus.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automobile door hanger apparatus, comprising:

a vertical member having a top end and a bottom end;

the vertical member configured to secure to a vertical surface;

a first support arm extending perpendicularly from the top end of the vertical member;

a second support arm extending perpendicularly from the bottom end of the vertical member;

a pair of first plates disposed on a base end of each of the first support arm and the second support arm;

a pair of second plates disposed on a distal end of each of the first support arm and the second support arm;

a pair of vertically oriented tubular members disposed on a pair of opposing ends of each of the first plates and the second plates, such that a first interface, a second interface, a third interface and a fourth interface are defined;

wherein each of the first interface, the second interface, the third interface and the fourth interface are configured to receive a removable automobile door thereon.

2. The automobile door hanger apparatus of claim 1, further comprising a mounting plate disposed on an edge of the vertical member between the first support arm and the second support arm.

3. The automobile door hanger apparatus of claim 1, wherein each of the first support arm and the second support arm comprises a brace thereon providing cantilever support from the vertical member.

4. The automobile door hanger apparatus of claim 3, wherein each brace comprises a plurality of apertures therein.

5. The automobile door hanger apparatus of claim 1, further comprising at least one support rod attached to a first support rod.

6. The automobile door hanger apparatus of claim 1, further comprising at least one support rod attached to a second support rod.

* * * * *